United States Patent [19]

Schonmeier

[11] Patent Number: 4,550,887

[45] Date of Patent: Nov. 5, 1985

[54] APPARATUS FOR THE SEPARATE WINDING OF SLIT WEBS

[75] Inventor: Herbert Schonmeier, Dusseldorf, Fed. Rep. of Germany

[73] Assignee: Jagenberg AG, Dusseldorf, Fed. Rep. of Germany

[21] Appl. No.: 606,445

[22] Filed: May 3, 1984

Related U.S. Application Data

[63] Continuation-in-part of Ser. No. 343,127, Jan. 27, 1982, abandoned.

[30] Foreign Application Priority Data

Jan. 29, 1981 [DE] Fed. Rep. of Germany ..... 3102894

[51] Int. Cl.[4] ..... B65H 19/20; B65H 17/00; B65H 35/02

[52] U.S. Cl. ..... 242/56.3; 242/65

[58] Field of Search ..... 242/56 R, 56.2, 56.3, 242/56.4, 56.9, 65, 66, 67.1 R

[56] References Cited

U.S. PATENT DOCUMENTS

| | | | |
|---|---|---|---|
| 3,030,042 | 4/1962 | DeGelleke | 242/56 |
| 3,188,016 | 6/1965 | Aaron | 242/65 |
| 3,633,840 | 1/1972 | Clark | 242/56 R |
| 3,792,824 | 2/1974 | Meyer et al. | 242/65 |
| 3,883,085 | 5/1975 | Held | 242/65 |
| 4,487,545 | 12/1984 | Schönmeier | 414/684 |

*Primary Examiner*—Stuart S. Levy
*Assistant Examiner*—Lloyd D. Doigan
*Attorney, Agent, or Firm*—Sprung Horn Kramer & Woods

[57] ABSTRACT

In an apparatus for separate winding of longitudinally slit webs 4 and comprising a single support roll 5 and at least two rolls 6 for winding the slit webs, which web rolls have shafts 10 and ride on the support roll 5, the improvement which comprises positioning the web rolls 6 on the upper half of the circumference of the support roll 5 on alternate sides of a vertical plane 7 passing through the axis of said support roll 5, the apparatus including a cross-bar 11, a plurality of web-roll carriages 12 carried by said cross-bar 11 for longitudinal displacement thereon and adapted to be positioned in pairs to the width of the web strips to be wound and hence be aligned with the slits, and load-carrying means 8, 9 of adjustable force disposed on the web-roll carriages 12 and operatively connected with the web-roll shafts 10.

1 Claim, 5 Drawing Figures

APPARATUS FOR THE SEPARATE WINDING OF SLIT WEBS

The present application is a continuation-in-part application of application Ser. No. 343,127 filed Jan. 27, 1982 and now abandoned.

BACKGROUND OF THE INVENTION

The invention relates to an apparatus for the separate winding of longitudinally slit webs onto at least two web rolls which ride on the upper half of the circumference of a single support roll on alternate sides of a vertical plane passing through the axis of said support roll and whose shafts are individually acted upon by a load-reducing means of adjustable force.

For the winding of slit webs onto two web rolls, apparatuses operating on two different principles are known. In a winding apparatus operating on one of these principles and known from German Pat. 11 96 463, for example, the web rolls, with their axes parallel, ride on two driven support rolls mounted close together with their axes parallel. Since the web rolls bear on the support rolls with their full weight, the bearing pressure which they exert on the support rolls increases steadily as the webs building up on them, and hence their weight, increases. As a result, the outer layers of the web roll are subjected to increasing mechanical stresses, the density of the web roll increases because of the steadily more pronounced roll-clearance effect, and ultimately the web will rupture if the stresses become too great. The roll-clearance effect at two support rolls further increases the stresses to which the web is subjected.

In the second type of such apparatuses, known from U.S. Pat. No. 3,792,824 issued Feb. 19, 1974, for example, two web rolls are mounted diametrically on the same shaft with their axes parallel and in the same horizontal plane, the web rolls being axially supported, spaced apart, on bearings and the bearings being horizontally displaceable radially in relation to the mounting shaft as the web builds up on them. In the apparatus, the weight of the web roll is absorbed by the shaft bearings. The stresses due to the weight of the web roll, which increase as the web-roll diameter increases, act upon the center of the web roll and there cause the web to rupture. The center must further absorb the horizontal forces required for the linear contact pressure which must be externally exerted on the ends of the web rolls by means of hydraulic or pneumatic cylinders. The vertically acting forces due to the weight and the horizontally acting forces due to the contact pressure add geometrically.

SUMMARY OF THE INVENTION

The object of the present invention is to provide a winding apparatus permitting wide slit rolls to be wound into large-diameter rolls of uniform density.

In accordance with the invention, this object is accomplished by simple means through an apparatus of the type outlined above.

The apparatus of the invention offers the advantage over prior-art apparatuses that the forces due to the weight of the web rolls are distributed and the introduction of external forces for the linear pressure can be dispensed with because axial unloading is applied and the web rolls are support on the support roll. Moreover, since there is only one support roll, there is no detrimental roll-clearance effect. Thus the web is damaged neither in the center nor at the periphery of the web rolls.

Preferred embodiments of the apparatus in accordance with the invention relate in part to the controllability of the load-reducing means, which permits the load represented by the web rolls to be reduced on the basis of the weight corresponding to the instantaneous web-roll diameter. By coordinating the magnitude of the load reduction with the instantaneous diameter of the web roll, in other words, by effecting a load reduction that is variable with time, the bearing pressure exerted by the web roll on the support roll can be controlled to influence the web-roll density in the desired manner. Without this expedient, the pressure exerted by the web roll on the support roll would increase, and with it the density of the web roll. What is sought, however, with a view to preventing excessive stressing of the web material both in the center of the roll and in the outer layers is a web-roll density that is uniform regardless of the diameter of the web roll. The load reduction is therefore preferably increased as the web-roll diameter increases in order to gradually decrease the pressure which the web roll exerts on the support roll. The load-reducing means may be formed by hydraulic or pneumatic cylinder/piston or electrical drive units.

By combining this load-reducing means with a web-roll carriage which can be horizontally positioned on a crossbar for different web widths, a simple and compact structural unit is obtained.

In accordance with a preferred embodiment of the apparatus of the invention, press-roll pairs mounted through pivot levers on longitudinal bars disposed on both sides of the apparatus can be caused to bear on the circumference of the web cores. In this way, the web rolls are pressed with adjustable force against the support roll, especially at the start of winding, and maintained in their position. The pivot lever with the press-roll pair is lifted off the circumference of the web roll as winding proceeds. In a preferred embodiment, the longitudinal bars can be raised and lowered when they are no longer needed and may also serve as protective means. At the end of the winding operation, the web rolls can then readily be removed from the machine.

BRIEF DESCRIPTION OF THE DRAWINGS

The invention will now be described in greater detail with reference to an embodiment illustrated in the accompanying drawing, wherein.

DETAILED DESCRIPTION OF THE INVENTION

Figure 2:
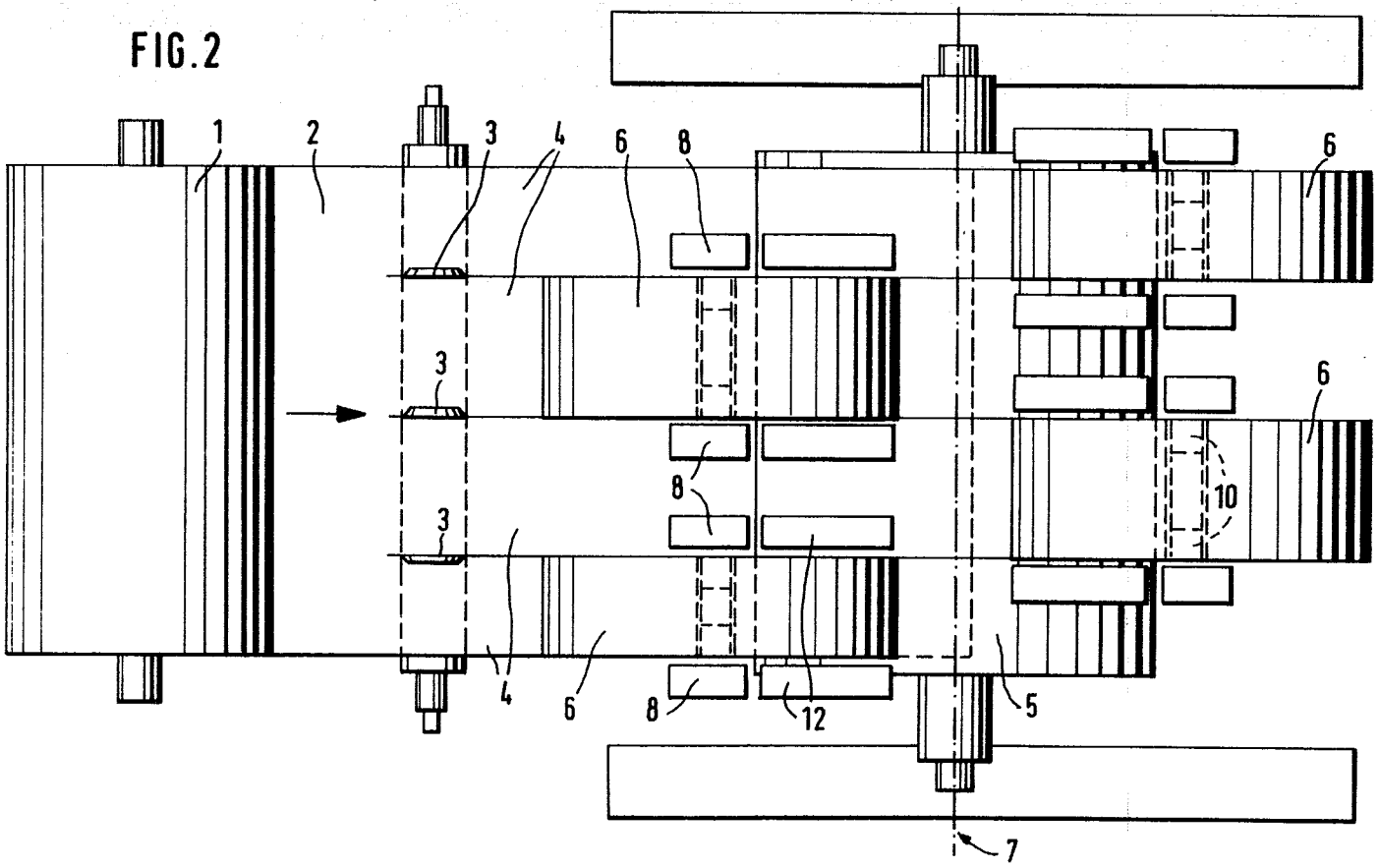
FIG. 2 is a top plan view of an embodiment of the apparatus of the invention comprising hydraulic or pneumatic means acting upon the shaft of the web roll for reduction of the load of the latter.

A web 2 is drawn from a supply roll 1 and longitudinally slit by circular blades into a plurality of strips 4 which are separately wound. (FIG. 3) The winding means provided therefor comprises a support roll 5 which is driven. Individually unloaded web rolls 6 ride on the support roll 5. The web rolls 6 ride on the upper circumferential portion of said support roll on alternate sides of a vertical plane 7 passing through the axis of the support roll 5. (FIG. 2).

A separate load-reducing means is provided for each web roll 6. Each of these means is formed by a pneumatic or hydraulic cylinder/piston unit 8 whose piston rods 9 bring about axial unloading of the web rolls 6 through stub shafts 10 set into the open ends of the web rolls 6. This unloading may be continuously controllable or adjustable as the diameter of the web rolls 6 increases, the increasing weight of said web rolls then being compensated by the load-reducing means 8 and 9 in such a way that a desired line pressure which determines the density of the web roll is obtained.

The load-reducing means 8 and 9 are secured to web-roll carriages 12 which are adapted to slide along the crossbar 11, thus permitting the web-roll carriages 12 to be positioned at right angles to the direction of web motion for different widths of the strips 4 and different slitting locations.

Figure 1:
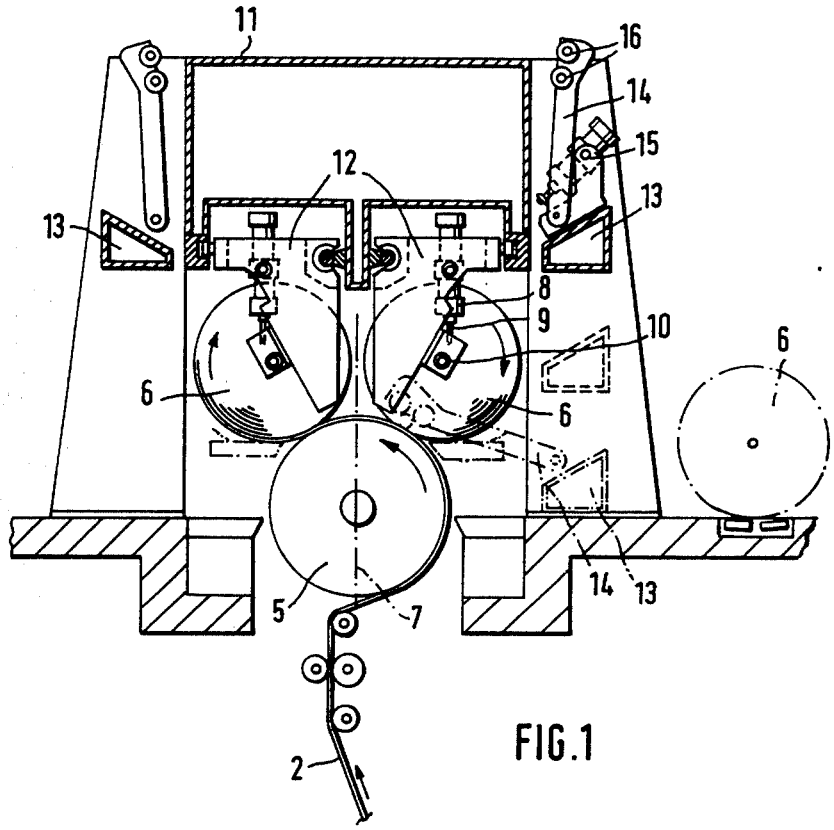
FIG. 1 is a side elevation.

On opposite sides of the support roll 5, pivot levers 14 are mounted on longitudinal bars 13 adapted to be raised and lowered, said pivot levers carrying a pair of press rolls 16 which by means of a pivot drive 15 are pressed against the web roll 6 at the start of the winding operation, as indicated in FIG. 1 by dash-dotted lines. The longitudinal bar 13 on the right-hand side of FIG. 1 is shown also in a middle position, indicated by broken lines, in which it can serve to protect the machine in the winding area. Before the web rolls 6 are removed at the end of the winding operation, the longitudinal bars 13 with the pivot levers 14 and the press rolls 16 are raised into the upper extreme position which in FIG. 1 is indicated by solid lines.

Figure 3:
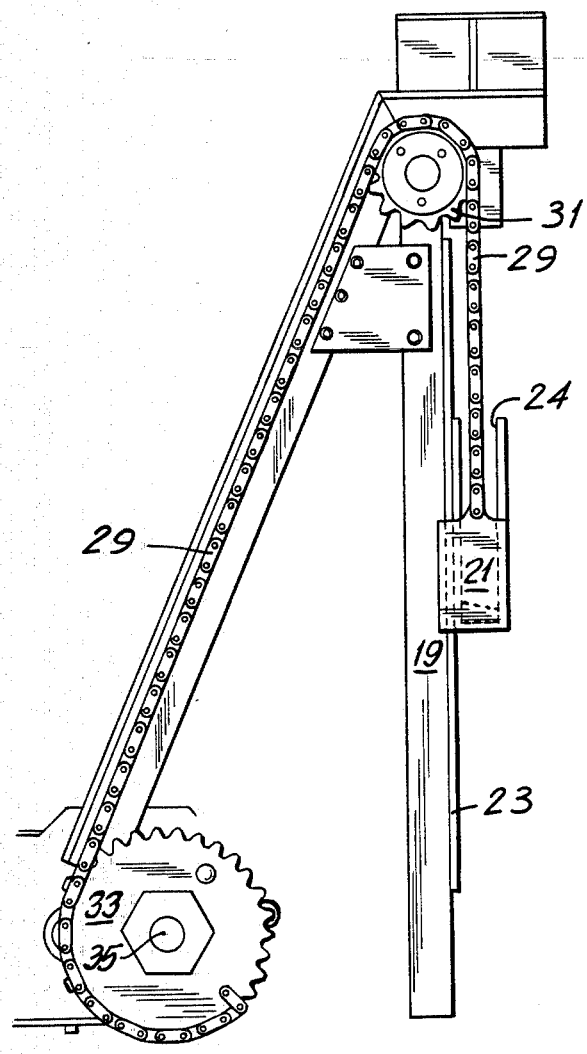
FIG. 3 is a side view of the mechanism for lifting the longitudinal bars.
Figure 4:
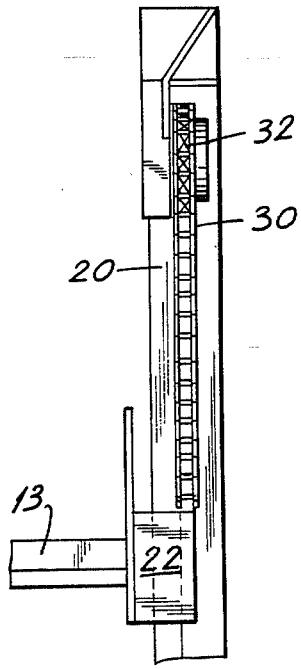
FIG. 4 is a partial front view of the mechanism of FIG. 3.
Figure 5:
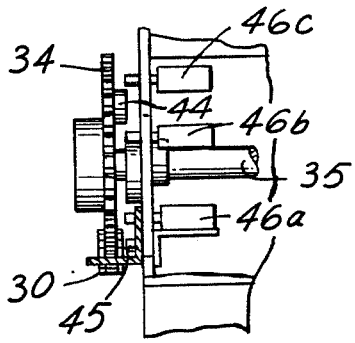
FIG. 5 is a detail of the mechanism of FIG. 3.

Referring to FIGS. 3–5, the machine for lowering and lifting bars is shown.

Mounted on opposite ends or sides of the frame are a pair of upright standards 19 and 20, each having a substantially T-shaped cross-section. Slidably mounted for vertical movement upon each standard 19 and 20 is a spindle bearing block or saddle bracket 21 and 22, respectively. Each bearing block, such as the block 21, is provided with a T-shaped slot or guideway 23 adapted to slidably receive the T-shaped standard 19. Each bearing block, such as block 21, also includes a vertically disposed spindle slot 24 open at its top for receiving the bar 13. Since each bearing block 21 and 22 is constructed identically, the opposite ends of the bars 13 are supported by the opposed bearing blocks 21 and 22.

Each bearing block 21 and 22 is attached to and suspended by one end of each chain 29 and 30, respectively, carried over upper sprockets 31 and 32, respectively. The opposite ends of the respective chains 29 and 30 are carried around the fixed to the driven sprockets 33 and 34, respectively, fixed at opposite ends of the driven shaft 35, by a motor (not shown).

The inside of the driven sprocket 34 is provided with a stop lug 44 adapted to engage stationary stop pin 45 fixed on frame 11 when the driven sprocket 34 has been rotated to a position in which the spindle block 22 has descended to its lowermost limit. A limit switch 46*a* is also mounted on the left side of the carriage 11 and in the path of the stop lug 44 so that the motor will automatically turned off when the bearing block 22 has reached or approaches its lowermost limit. Limit switches 46*b* and 46*c* are provided for the other two positions for bars 13, as shown in FIG. 1.

It will be appreciated that the instant specification and claims are set forth by way of illustration and not limitation, and that various changes and modifications may be made without departing from the spirit and scope of the present invention.

What is claimed is:

1. In an apparatus for the separate winding of longitudinally slit webs having a single support roll and at least two web rolls for winding the slit webs, which web rolls have shafts and ride on the support roll, the improvement comprising: means for positioning the web rolls on the upper half of the circumference of the support roll on alternate sides of a vertical plane passing through the axis of said support roll; a cross-bar extending parallel to the axis of the support roll; a plurality of web-roll carriages carried by said cross-bar for displacement along the cross-bar parallel to the axis of the support roll positioned in pairs corresponding to the width of the web strips to be wound and thereby to be aligned with the slits; load-reducing means disposed on the web-roll carriages and operatively connected with the web-roll shafts for reducing the web-roll load as a function of the instantaneous diameter of the web roll; vertically displaceable support bars disposed at the sides of and parallel to the cross-bars; a pair of press rolls for each of the web rolls; pivot levers pivotally connecting each pair of press rolls to the support bars for vertical displacement with the support bars and to enable the press rolls to contact the circumference of a web roll; and means for urging the pivot levers to press the press rolls against the circumference of the web rolls.

* * * * *